US011828281B2

(12) United States Patent
Dorner et al.

(10) Patent No.: US 11,828,281 B2
(45) Date of Patent: Nov. 28, 2023

(54) METHOD FOR OPERATING A PISTON COMPRESSOR, AND PISTON COMPRESSOR

(71) Applicant: Linde GmbH, Pullach (DE)

(72) Inventors: Sascha Dorner, Gramatneusiedl (AT); Christoph Nagl, Alland (AT); Johannes Fritzer, Vienna (AT); Klaus Fischer, Vienna (AT)

(73) Assignee: Linde GmbH, Pullach (DE)

( * ) Notice: Subject to any disclaimer, the term of this patent is extended or adjusted under 35 U.S.C. 154(b) by 634 days.

(21) Appl. No.: 16/765,912

(22) PCT Filed: Nov. 6, 2018

(86) PCT No.: PCT/EP2018/025281
§ 371 (c)(1),
(2) Date: May 21, 2020

(87) PCT Pub. No.: WO2019/101361
PCT Pub. Date: May 31, 2019

(65) Prior Publication Data

US 2020/0309116 A1 Oct. 1, 2020

(30) Foreign Application Priority Data

Nov. 22, 2017 (DE) ..... 10 2017 010 789.0

(51) Int. Cl.
*F04B 49/16* (2006.01)
*F04B 25/00* (2006.01)
(Continued)

(52) U.S. Cl.
CPC ..... *F04B 49/16* (2013.01); *F04B 25/005* (2013.01); *F04B 1/02* (2013.01); *F04B 9/107* (2013.01);
(Continued)

(58) Field of Classification Search
CPC ..... F04B 49/16; F04B 25/005; F04B 1/02; F04B 9/08; F04B 9/10; F04B 9/107;
(Continued)

(56) References Cited

U.S. PATENT DOCUMENTS

2012/0302945 A1* 11/2012 Hedmann ..... F04B 49/08 73/19.05
2015/0322976 A1* 11/2015 Rabhi ..... F04B 9/107 60/591
(Continued)

FOREIGN PATENT DOCUMENTS

AT 3 213 U1 11/1999
AT 3213 U1 * 11/1999 ..... F04B 49/16
DE 10 2007 033601 B3 11/2008

OTHER PUBLICATIONS

International Search Report of the International Searching Authority for PCT/EP2018/025281 dated Feb. 12, 2019.
(Continued)

*Primary Examiner* — Kenneth J Hansen
*Assistant Examiner* — David N Brandt
(74) *Attorney, Agent, or Firm* — MILLEN WHITE ZELANO & BRANIGAN, PC; Brion P. Heaney

(57) ABSTRACT

The invention relates to a method for operating a piston compressor (100) having a reciprocating piston (111) in a cylinder (110), wherein an inlet valve (112) and an outlet valve (113) are provided in the cylinder (110) on the side of a medium (b) which is to be compressed and conveyed, wherein the reciprocating piston (111) is moved to and fro by way of a hydraulic drive (120, 121) with a hydraulic piston (120) with the use of a hydraulic medium (a) in a first volume (141), with which the reciprocating piston (111) is loaded on the side of the hydraulic drive (120, 121), wherein, if required, hydraulic medium (a) is fed into the first volume (141) and/or is discharged from the first volume
(Continued)

(141) in a manner which is dependent on a position of the hydraulic piston (120) and/or a rotational angle ((p) of a shaft (121) which is provided for moving the hydraulic piston (120) in relation to a position (x) of the reciprocating piston (120) and/or a pressure (p) in the first volume (141), and to a piston compressor (100) of this type.

22 Claims, 1 Drawing Sheet

(51) Int. Cl.

| | |
|---|---|
| ***F04B 1/02*** | (2006.01) |
| ***F04B 9/109*** | (2006.01) |
| ***F04B 19/22*** | (2006.01) |
| ***F04B 27/00*** | (2006.01) |
| ***F04B 49/00*** | (2006.01) |
| ***F04B 49/08*** | (2006.01) |
| ***F04B 49/22*** | (2006.01) |
| ***F04B 53/10*** | (2006.01) |
| ***F04B 9/107*** | (2006.01) |

(52) U.S. Cl.
CPC ..... *F04B 9/109* (2013.01); *F04B 19/22* (2013.01); *F04B 27/005* (2013.01); *F04B 49/002* (2013.01); *F04B 49/08* (2013.01); *F04B 49/22* (2013.01); *F04B 53/10* (2013.01); *F04B 2201/0201* (2013.01)

(58) Field of Classification Search
CPC ..... F04B 9/109; F04B 19/22; F04B 27/005; F04B 49/002; F04B 49/08; F04B 49/22; F04B 53/10; F04B 2201/0201; F04B 2201/0206; F04B 2201/0808
See application file for complete search history.

(56) References Cited

U.S. PATENT DOCUMENTS

2018/0372083 A1* 12/2018 Hembree ..... F04B 43/0081
2019/0032646 A1* 1/2019 Adler ..... F04B 35/008

OTHER PUBLICATIONS

English translation of International Search Report of the International Searching Authority for PCT/EP2018/025281 dated Feb. 12, 2019.

* cited by examiner

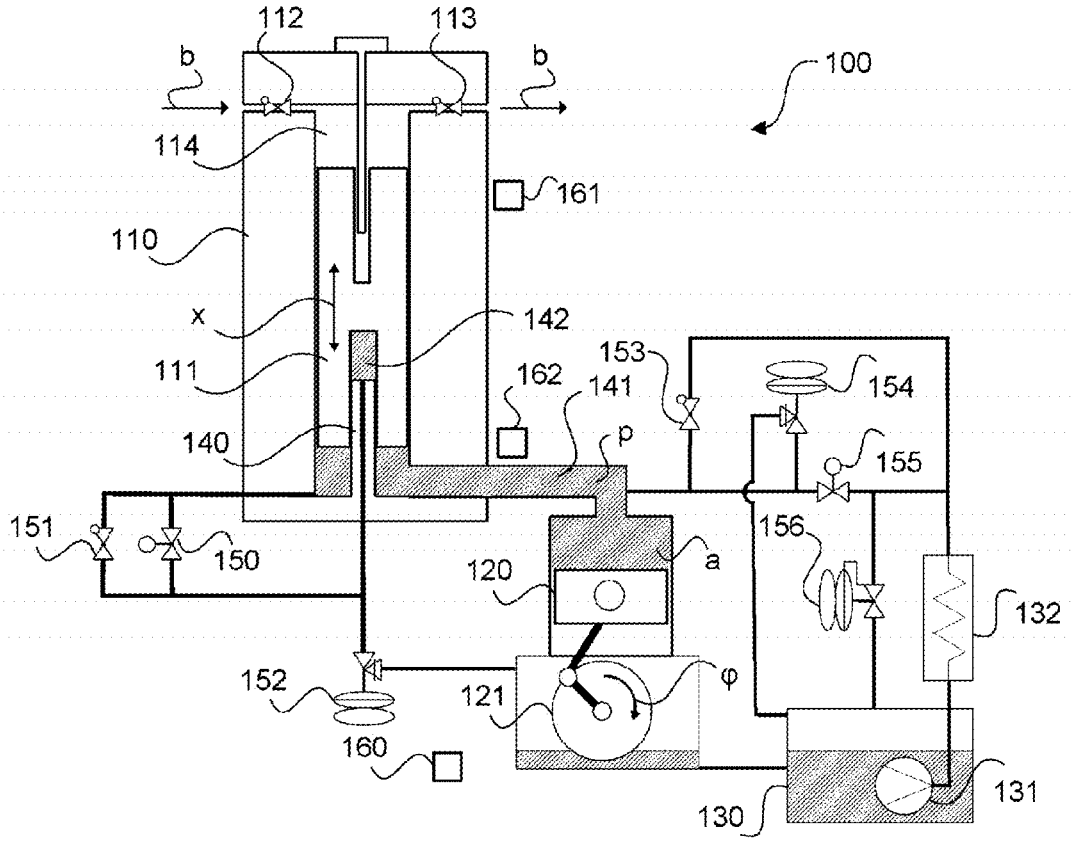
112
113
b
b
100
114
161
110
x
142
111
153
154
162
141
140
p
155
151
150
156
120
a
132
152
121
φ
160
131
130

METHOD FOR OPERATING A PISTON COMPRESSOR, AND PISTON COMPRESSOR

The invention relates to a method for operating a piston compressor and to a piston compressor.

Compressors are used in particular for compressing gaseous media. The efficiency of conventional piston compressors is very strongly influenced by the presence of residual volume or dead space in the top dead center. Gas or medium in this region leads to a re-expansion and a reduction in the inflowing delivery volume possible in the suction cycle. This region is unavoidable, in order to compensate for manufacturing tolerances and thermal expansions of the components, and to subsequently avoid mechanical contact of the reciprocating pistons with the cylinder head in the compressor. Channels for the suction and pressure valves (i.e., inlet and outlet valves) increase this negative effect.

The reduction of this dead space reduces the re-expansion of the remaining medium and thereby increases the delivery volume or the efficiency of the compression process. So-called ionic compressors—in particular, piston compressors—are operated hydraulically, on the one hand, and, on the other, compress a two-phase mixture consisting of a medium or gas and a liquid lubricant (i.e., an ionic fluid), which cannot evaporate, and for this reason can be completely separated again by a simple deposition process. The advantage of such an ionic compressor is that, by using a liquid phase in the compression chamber, the dead space in the cylinder can be reduced to a minimum, thereby optimizing the efficiency of the compression process.

What results, disadvantageously, are the additional component loads and thereby increased sound emissions due to the characteristic similar to a liquid strike. In addition, in hydraulically-driven compression concepts, an oil filling quantity must, if necessary, be controlled and compensated for, due to internal leakage in the hydraulic circuit. The main problems result from mechanical contacts in the reversal points of the reciprocating pistons and thereby increased component loading and noise emissions, which are to be considered problematic—especially in the case of installation in the vicinity of residential areas—and require additional sound insulation.

The concept of damping, for example—in particular, in the case of shock absorbers—is known from the field of automobile assembly. In this case, kinetic energy is dissipated in the form of vibrations. In addition to reducing undesired fluctuation or oscillation of the vehicle, this also enables the reduction of component loads and sound emissions.

Against this background, the aim put forward is to provide a possibility of improving the operation of a piston compressor—in particular, with respect to component loading and sound emission.

DISCLOSURE OF THE INVENTION

This aim is achieved by a method for operating a piston compressor and by a compressor having the features of the independent claims. Preferred embodiments are the subject matter of the dependent claims and the following description.

ADVANTAGES OF THE INVENTION

The invention relates to a method for operating a piston compressor having a reciprocating piston in a cylinder, wherein an inlet valve and an outlet valve (or a suction valve and a pressure valve) are provided in the cylinder on the side of a medium to be compressed and conveyed (i.e., in the cylinder head). With a hydraulic drive, which comprises a hydraulic piston, the reciprocating piston is moved to and fro (or up and down) with the use of a hydraulic medium in a first volume, with which the reciprocating piston is loaded on the side of the hydraulic drive.

The hydraulic piston oscillates in the cylinder between two reversal points—the so-called bottom dead center (BDC) and the so-called top dead center (TDC). When moving in the direction of the top dead center, medium present in the cylinder or cylinder head is compressed and then discharged through the outlet valve; when moving in the direction of the bottom dead center, medium is drawn in through the inlet valve.

In principle, the reciprocating piston would be moved synchronously with the hydraulic piston in this case. However, due to leakage effects in the circuit of the hydraulic medium (i.e., the first volume mentioned), it may happen that the reciprocating piston is no longer moved synchronously with the hydraulic piston. This means that, for example, at the bottom dead center, the reciprocating piston strikes the cylinder bottom, but the hydraulic piston moves further downward. This produces a negative pressure in the first volume or in the hydraulic circuit. The reciprocating piston can also strike the cylinder head, while the hydraulic piston moves further upward. This produces an overpressure in the first volume or in the hydraulic circuit.

It is now provided that, when required, hydraulic medium be fed into the first volume and/or discharged from the first volume in a manner which is dependent upon a position of the hydraulic piston and/or a rotational angle of a shaft provided for moving the hydraulic piston in relation to a position of the reciprocating piston and/or a pressure in the first volume. In the process, the respective variables can be determined by means of one or more suitable measuring devices.

The position of the hydraulic piston and the rotational angle of the shaft provided for moving the hydraulic piston are linked to one another and indicate a current position of the hydraulic drive. The position of the reciprocating piston and the pressure in the first volume are also linked to one another, inasmuch as that, when the reciprocating piston strikes in the cylinder, the pressure rises or falls. If these variables are now determined, they can be set in relation to one another so that it can be detected whether a strike of the reciprocating piston occurs or, if applicable, whether such a strike of the reciprocating piston is imminent. Accordingly, hydraulic medium can then be fed into the first volume or discharged from the first volume.

When or before the hydraulic piston strikes the cylinder bottom at the bottom dead center, the negative pressure occurring in the first volume or in the hydraulic circuit can thus be counteracted by supplying hydraulic medium. The strike can thus be reduced or even prevented, which brings about a reduction in sound emissions and component loading.

Accordingly, a strike to the top dead center can be reduced or even prevented by discharging hydraulic medium, which likewise brings about a reduction in sound emissions and component loading. Suitable valves can be provided for this purpose, which are correspondingly actuated, i.e., opened or closed. For a more detailed description of such valves, reference is made at this point to the description of the piston compressor or the description of the figures.

Preferably, with a hydraulic damping unit using the hydraulic medium and forming a second volume at least partially bounded by the reciprocating piston, movement of the reciprocating piston on the side of the hydraulic drive is limited when necessary. Such a damping unit can be used not only for further damping the movement of the reciprocating piston, but also for adjusting a compression ratio.

For this purpose, the second volume is preferably connected to the first volume in order to reduce a quantity of medium to be conveyed by means of the piston compressor. This is accompanied by an increase in dead space in the cylinder head. For this purpose, excess hydraulic medium (thus, in order to reduce hydraulic medium in the second volume) is discharged from the first volume into a reservoir. It is also preferred if the first volume is connected to the reservoir for the hydraulic medium, in order to increase a quantity of medium to be conveyed by means of the piston compressor. This is accompanied by a reduction of dead space in the cylinder head. In this case, required hydraulic medium (thus, in order to increase the quantity of hydraulic medium in the second volume or to fill up the second volume) is supplied from the reservoir.

When required, the second volume can thus be filled with more or less hydraulic medium. Since the movement of the reciprocating piston in the direction of the bottom dead center (thus, in the direction of the hydraulic drive) can be limited by the hydraulic medium in the second volume, the volume which is available for compression at the cylinder head or at the top dead center can thus be changed. Accordingly, the compression ratio can be changed.

A multi-stage piston compressor having at least two reciprocating pistons and corresponding cylinders is, advantageously, used as the piston compressor. However, movement of these reciprocating pistons in the corresponding cylinders can still take place with the one hydraulic drive, and then with a corresponding number of such first volumes. It goes without saying that a corresponding number of such damping units can then also be provided. Depending upon the situation, the individual cylinders can then be arranged, for example, in series or in the shape of a star. The compression then takes place in such a way that medium discharged from a cylinder is supplied to another cylinder and is further compressed there.

It is particularly preferred if an ionic fluid is used as the operational fluid. In this connection, the compressor is also referred to as a so-called ionic compressor. As already mentioned above, such ionic compressors offer advantages, such as a reduced dead volume. Through the supply or discharge of hydraulic medium proposed here, the remaining disadvantages of sound emission or component wear can now also be reduced.

The invention further relates to a piston compressor having a reciprocating piston in a cylinder, wherein an inlet valve and an outlet valve are provided in the cylinder on the side of a medium to be compressed and conveyed. In addition, the piston compressor has a hydraulic drive with a hydraulic piston, by means of which the reciprocating piston can be moved to and fro in a first volume with the use of a hydraulic medium, with which the reciprocating piston can be loaded on the side of the hydraulic drive. In this case, at least one measuring device is provided, by means of which a position of the hydraulic piston and/or a rotational angle of a shaft provided for moving the hydraulic piston, and a position of the reciprocating piston and/or a pressure in the first volume can be determined. The piston compressor is now configured to feed hydraulic medium into the first volume and/or to discharge it from the first volume when required, in a manner which is dependent upon the position of the hydraulic piston and/or the rotational angle of the shaft provided for moving the hydraulic piston in relation to the position of the reciprocating piston and/or the pressure in the first volume.

Preferably, the piston compressor further comprises a hydraulic damping unit by means of which, using the hydraulic medium and forming a second volume at least partially bounded by the reciprocating piston, movement of the reciprocating piston on the side of the hydraulic drive can be limited when required. Advantageously provided in this case are a first valve, by means of which the second volume can be connected to the first volume, and a second valve, by means of which hydraulic medium can be discharged from the first volume into a reservoir for the hydraulic medium. A quantity of medium to be conveyed by means of the piston compressor can thus be reduced. It is also preferred if a third valve is provided, by means of which the first volume can be connected to the reservoir for the hydraulic medium. Hydraulic medium can thus be supplied to the first volume. This third valve can preferably also be designed in such a way that hydraulic medium can be supplied automatically from the reservoir to the first volume if a lower pressure is present on the side of the first volume than on the side of the reservoir. For this purpose, the third valve can be designed, for example, as a check valve.

The piston compressor is advantageously designed as a multi-stage piston compressor having at least two reciprocating pistons and corresponding cylinders. An ionic fluid is, expediently, provided in the piston compressor as the operational fluid.

With respect to the detailed explanation, as well as further preferred embodiments and advantages of the piston compressor according to the invention, in order to avoid repetition, reference is made to the above explanations, which accordingly apply here, concerning the method according to the invention, which is explained with reference to a piston compressor.

The invention is schematically represented in the drawing using an exemplary embodiment and is described below with reference to the drawing.

BRIEF DESCRIPTION OF THE DRAWING

FIG. 1 schematically shows a piston compressor according to the invention in a preferred embodiment which is suitable for carrying out a method according to the invention.

DETAILED DESCRIPTION OF THE DRAWING

FIG. 1 schematically shows a piston compressor 100 according to the invention in a preferred embodiment which is suitable for carrying out a method according to the invention.

The piston compressor 100, also referred to as a reciprocating piston compressor in the form shown, comprises a cylinder 110 in which a reciprocating piston 111 can be moved to and fro or up and down. In principle, such a piston compressor may be multi-stage, i.e., several of the cylinders 110 shown with reciprocating pistons 111 may be present. The following description relating to the cylinder with a reciprocating piston then applies accordingly also to further cylinders with reciprocating pistons.

The piston compressor 100 is driven by a hydraulic drive, which here comprises a hydraulic piston 120. The hydraulic piston 120 is driven by a rotary wheel with shaft 121 with suitable linkage (hydraulic crank drive). Rotation of this shaft 121, as indicated by an arrow, leads to up-and-down movement of the reciprocating piston 111 by the use of hydraulic medium a (hydraulic oil) in a first volume 141, as likewise indicated by an arrow. The reciprocating piston 111 oscillates in the cylinder 110 between two reversal points, referred to as bottom dead center (BDC) and top dead center (TDC).

The frequency at which the shaft rotates and the reciprocating piston moves up and down can be, for example, between 0.5 Hz and 12 Hz (but is generally kept constant); the stroke of the reciprocating piston can be, for example, between 30 mm and 100 mm. The stroke or the stroke volume of the hydraulic piston is, generally, also constant.

The hydraulic medium a is thus conveyed here to the bottom side of the reciprocating piston 111. The reciprocating piston 111 is accordingly moved upwards and compresses a two-phase mixture in the so-called gas cylinder 114, i.e., the upper region of the cylinder. This two-phase mixture here comprises, on the one hand, a medium b to be compressed and conveyed and, on the other, an ionic operational fluid. If the pressure in the cylinder 110 exceeds the back pressure at the pressure valve or outlet valve 113, the latter is opened, and the medium b is conveyed approximately isobarically into the pressure region until the top dead center is reached.

As soon as the hydraulic piston 120 moves downwards, the back pressure in the cylinder 110 is undershot, and the outlet valve 113 is closed.

The downward-moving reciprocating piston 111 reduces the pressure in the cylinder 110 until the applied pressure at the suction valve or inlet valve 112 falls below the level in the suction region.

The less residual volume or dead space there is, the earlier the inlet valve 112 can open and the drawn-in quantity be increased proportionally thereto. Due to the system, the position of the reciprocating piston 111 can deviate from the stroke position of the hydraulic piston 120. The leakage-laden compression in the hydraulic drive subsequently results in the hydraulic medium a conveyed past the hydraulic piston 120 first entering a reservoir 130 (or a tank).

From there, it can be conveyed back to the hydraulic circuit or the first volume 141 via a pump 131 and a heat exchanger 132 and, lastly, a check valve 153, in order to compensate for the positional deviations between the hydraulic piston 120 and the reciprocating piston 111.

The required quantity can now, within the scope of the present invention, be calculated and corrected, e.g., via a data comparison between a measuring device 161 (for example, a displacement measuring system) and a measuring device 160 (for example, a rotational angle sensor). For example, while the position x of the reciprocating piston 111 can be determined by means of the measuring device 161, a rotational angle φ of the shaft 121 can be determined with the measuring device 160. In addition, a pressure p in the first volume 141 can, for example, also be detected by means of a suitable measuring device 162.

The reciprocating piston 111 striking the cylinder head is now detected by an excessive pressure increase at the end of the actual isobar extension phase, whereby the excess hydraulic medium is conveyed via a pressure limiting valve 154 back into the reservoir 130.

Mechanical contact of the reciprocating piston 111 with the piston or cylinder bottom is detected by a pressure shortfall during the inflow phase. In this case, the missing quantity of hydraulic medium is drawn or supplied via the check valve 153 (also referred to as third valve within the scope of the invention), in order to move the reciprocating piston 111 into the normal range.

Because, for example, a pressure measurement is now taken in the first volume in a manner which is dependent upon the rotational angle of the shaft 121, it can be detected when a strike of the reciprocating piston 111 to the cylinder head or cylinder bottom occurs or is imminent, and hydraulic medium can be discharged or supplied, e.g., by suitable actuation of the valves 153 or 154.

Furthermore, a damping unit 140 is provided by means of which an adaptive damping system can be realized, irrespective of the frequency, of the pressure ratios in the piston compressor and of the leakage in the hydraulic region. This damping unit 140 can be used to dampen the downward movement of the reciprocating piston 111 and thus to reduce the sound emissions and mechanical loads during the movement in the direction of the bottom dead center. By means of damping unit 140 movement of the reciprocating piston 111 on the side of the hydraulic drive 120, 121 can be limited as needed, using the hydraulic medium a. The damping unit 140 includes a second volume 142 at least partially bounded by the reciprocating piston 111. The second volume 142 can be connected to the first volume 141 via a first valve 150. By means of a second valve 155, hydraulic medium a can be discharged from the first volume 141 into the reservoir 130.

If a leakage in the oil circuit, i.e., here, in the first volume 141, is detected via the rotational-angle-resolved pressure measurement in the hydraulic system, i.e., here, in the first volume 141, this can be compensated for. In addition, it is possible to adjust the top dead center as well as the bottom dead center, and thus the compression ratio or the delivered quantity of medium, by the adaptive damping system. For this purpose, additional hydraulic medium is supplied, or excess hydraulic medium is discharged or pushed back into the reservoir, depending upon the demand or need for the required quantity.

If the delivered quantity is to be increased, or the existing dead space is to be reduced, the first valve 150 is closed. The reciprocating piston 111 is thereby prevented from moving in the direction of the bottom dead center or in the direction of the hydraulic drive, even though the hydraulic piston 120 moves downwards. The required quantity of hydraulic medium is thereby drawn via the check valve 153 into the circuit or into the first volume 141 due to the resulting negative pressure. When the hydraulic piston 120 moves upwards again, the system is closed, and the reciprocating piston 111 has been raised by a defined volume (by the additionally conveyed quantity of hydraulic medium), whereby the dead space is reduced, and the delivered quantity of medium to be compressed is increased.

If the quantity of hydraulic medium is increased too much, and the reciprocating piston 111 is in danger of colliding with the cylinder head, the second valve 155 can be opened, and the filling quantity can be reduced.

If the delivered quantity is to be reduced, or the existing dead space is to be increased, the first valve 150 is opened, in order to not influence the downward movement of the reciprocating piston 111. At the same time, the second valve 155 is opened in order to reduce or discharge a defined quantity of hydraulic medium, which is caused by the upward movement of the hydraulic piston 120. When the required position of the reciprocating piston is reached, the first valve 150 can be closed again.

If this is done before the hydraulic piston 120 reaches the bottom dead center, the hydraulic piston replenishes the necessary quantity of hydraulic medium via the check valve 153.

In a control loop, by repeated iteration, these adjustments can be brought closer to the required operating point. If a change in the intermediate circuit pressures of the individual stages is required (thus, in the case of a multi-stage piston compressor), this can take place in the same way as just described. Only the pressure is used as a control variable and reconciled in the circuit with the other stages.

If an operating point has been set, a change in the pressure in the system is directly proportional to the position of the reciprocating piston 111. A deviation in the position of the position x of the reciprocating piston 111 associated with the rotational angle φ of the shaft 121 due to leakage can take place by blocking the reciprocating piston 111 by means of the damping unit 140; hydraulic medium is replenished via the check valve 153, and the incorrect position is compensated for.

This adaptive damping system makes it possible to optimize hydraulically-driven piston compressors with respect to the usable stroke volume. It is made possible to have the piston travel vary and to optimize the delivery volume, pressure, and effectiveness according to the requirements of the system.

The residual volume between the reciprocating piston and the cylinder head—the so-called dead space—expands during the downward movement of the reciprocating piston and, depending upon the magnitude, influences the opening time of the normally spring-actuated suction valve. The larger the dead space is, the later it opens, and the less delivery volume can be drawn in.

This directly influences the efficiency of the respective compressor stage. Adaptation of the intermediate circuit pressures, which may be necessary in certain operating ranges, can thus take place in coordination with the remaining stages. It is thus possible with the proposed method or the piston compressor to realize in the intermediate circuit a great variability with respect to the required delivery volume and the applied pressures.

The possibility of damping the reciprocating piston and of optimizing the stroke makes it possible to permanently reduce mechanical loads, which, on the one hand, leads to an increase in the possible service life of the compressor components and, on the other, allows the use of materials of a lower quality, and thereby offers more leeway as to cost optimization with respect to raw material and production costs.

The effects mentioned are accompanied by the lowering of the vibrations and noise emissions, as a result of which savings can also be achieved with respect to previously necessary damping measures, and the operation of, for example, a tank control system (in which, for example, hydrogen is compressed with such a piston compressor) in residential areas can, consequently, be made easier.

As a result of the configuration described, such a piston compressor is very variable and thereby simplifies the application of a modular system, even with respect to differing operating media, limit values, and requirements, and thus permits simpler mass production due to the now possible structural uniformity of the individual components, despite differing applications.

An expansion of existing or already delivered piston compressors to a proposed piston compressor allows optimization of the operating parameters and an increase in efficiency. In addition, it is possible to increase existing service lives and to reduce vibrations and sound emissions.

The integration into an existing system (i.e., an existing piston compressor or several thereof) can be carried out in the course of a routine maintenance process. For this purpose, a displacement measuring system and a rotational angle transmitter (in the sense of the mentioned measuring devices) can, additionally, be attached, and the automation programming of the system can be expanded by the necessary control routines.

A further embodiment consists in the possibility—in conjunction with controllable suction and pressure valves, e.g., on a piezoelectric basis, as are used, for example, in automotive applications—of implementing an expander system. Such an expander system uses the expansion work in the expansion of the gas, e.g., in a dispensing system, in which gas of a lower pressure level is required, and can thereby, on the basis of an energy recovery system, be used for power generation.

The invention claimed is:

1. A piston compressor (100) comprising:

a reciprocating piston (111) in a cylinder (110), wherein an inlet valve (112) and an outlet valve (113) are provided in the cylinder (110) for introducing and discharging a medium (b) that is to be compressed and conveyed by the compressor, a hydraulic drive (120, 121) with a hydraulic piston (120) by means of which the reciprocating piston (111) is moved to and fro with the use of a hydraulic medium (a) in a first volume (141), positioned between the reciprocating piston (111) and the hydraulic piston (120), with which a side of the reciprocating piston (111) facing the hydraulic drive (120, 121) can be loaded, a first measuring device (160) by means of which a position of the hydraulic piston (120) and/or a rotational angle (φ) of a shaft (121) provided for moving the hydraulic piston (120), and a second measuring device (161,162) by means of which a position (x) of the reciprocating piston (111) and/or a pressure (p) in the first volume (141) can be determined, and a hydraulic damping unit (140) by means of which movement of the reciprocating piston (111) can be limited as needed, using the hydraulic medium (a), said hydraulic damping unit comprising a second volume (142) at least partially bounded by the reciprocating piston (111), wherein the piston compressor (100) is configured to feed the hydraulic medium (a) into the first volume (141) and/or to discharge the hydraulic medium (a) from the first volume (141) when required, in a manner which is dependent upon the position of the hydraulic piston (120) and/or the rotational angle (φ) of the shaft (121) provided for moving the hydraulic piston (120) in relation to the position (x) of the reciprocating piston (111) and/or the pressure (p) in the first volume (141), said piston compressor (100) further comprising a first valve (150) by means of which the second volume (142) can be connected to the first volume (141), and a second valve (155) by means of which the hydraulic medium (a) can be discharged from the first volume (141) into a reservoir (130) for the hydraulic medium, and/or a third valve (153) by means of which the first volume (141) can be connected to the reservoir (130) for the hydraulic medium.

2. The piston compressor (100) according to claim 1, which is a multi-stage piston compressor, said multi-stage piston compressor further comprising at least one further reciprocating piston and at least one further corresponding cylinder.

3. The piston compressor (100) according to claim 1, in which an ionic fluid is provided as an operational fluid.

4. A method for operating the piston compressor according to claim 1, said method comprising: moving the reciprocating piston (111) to and fro by way of the hydraulic drive (120, 121) with the hydraulic piston (120) with the use of the hydraulic medium (a) in the first volume (141) positioned between the reciprocating piston (111) and the hydraulic piston (120), with which the reciprocating piston (111) is loaded on a side of the hydraulic drive (120, 121), feeding the hydraulic medium (a) into the first volume (141) and/or discharging the hydraulic medium (a) from the first volume (141); wherein said feeding and/or discharging is dependent upon: (a) the position of the hydraulic piston (120); and/or (b) the rotational angle (p) of the shaft (121) which is provided for moving the hydraulic piston (120); in relation to (c) the position (x) of the reciprocating piston (111); and/or (d) the pressure (p) in the first volume (141).

5. The method according to claim 4, wherein, with the hydraulic damping unit (140) using the hydraulic medium (a) and forming the second volume (142) at least partially bounded by the reciprocating piston (111), movement of the reciprocating piston (111) on the side of the hydraulic drive (120, 121) is limited as needed.

6. The method according to claim 5, wherein the second volume (142) is connected to the first volume (141) in order to reduce a quantity of medium (b) to be conveyed by means of the piston compressor (100), wherein excess hydraulic medium (a) is discharged from the first volume (141) into the reservoir (130), and/or wherein the first volume (141) is connected to the reservoir (130) for the hydraulic medium in order to increase a quantity of medium (b) to be conveyed by means of the piston compressor (100), wherein required hydraulic medium is supplied from the reservoir (130).

7. The method according to claim 1, wherein the piston compressor is a multi-stage piston.

8. The method according to claim 4, wherein an ionic fluid is used as an operational fluid.

9. The method according to claim 1, wherein the hydraulic medium is fed into the first volume dependent upon: (a) the position of the hydraulic piston.

10. The method according to claim 4, wherein the hydraulic medium is fed into the first volume dependent upon: (b) the rotational angle (p) of the shaft which is provided for moving the hydraulic piston in relation to the position (x) of the reciprocating piston.

11. The method according to claim 4, wherein the hydraulic medium is fed into the first volume dependent upon: (c) the pressure (p) in the first volume.

12. The method according to claim 4, wherein the hydraulic medium is fed into the first volume dependent upon: (a) the position of the hydraulic piston; (b) the rotational angle (p) of the shaft which is provided for moving the hydraulic piston in relation to the position (x) of the reciprocating piston; and (c) the pressure (p) in the first volume.

13. The method according to claim 4, wherein the hydraulic medium is discharged from the first volume dependent upon: (a) the position of the hydraulic piston.

14. The method according to claim 4, wherein the hydraulic medium is discharged from the first volume dependent upon: (b) the rotational angle (p) of the shaft which is provided for moving the hydraulic piston in relation to the position (x) of the reciprocating piston.

15. The method according to claim 4, wherein the hydraulic medium is discharged from the first volume dependent upon: (c) the pressure (p) in the first volume.

16. The method according to claim 4, wherein the hydraulic medium is discharged from the first volume dependent upon: (a) the position of the hydraulic piston; (b) the rotational angle (p) of the shaft which is provided for moving the hydraulic piston in relation to the position (x) of the reciprocating piston; and (c) the pressure (p) in the first volume.

17. A piston compressor (100) comprising:

a reciprocating piston (111) in a cylinder (110), wherein an inlet valve (112) and an outlet valve (113) are provided in the cylinder (110) for introducing and discharging a medium (b) that is to be compressed and conveyed by the compressor, a hydraulic drive (120, 121) with a hydraulic piston (120) by means of which the reciprocating piston (111) is moved to and fro with the use of a hydraulic medium (a) in a first volume (141), positioned between the reciprocating piston (111) and the hydraulic piston (120), with which the reciprocating piston (111) can be loaded on a side of the hydraulic drive (120, 121) facing the hydraulic drive, a first measuring device (160) by means of which a position of the hydraulic piston (120) and/or a rotational angle (φ) of a shaft (121) provided for moving the hydraulic piston (120), and a second measuring device (161,162) by means of which a position (x) of the reciprocating piston (111) and/or a pressure (p) in the first volume (141) can be determined, and a hydraulic damping unit (140) by means of which movement of the reciprocating piston (111) can be limited as needed, using the hydraulic medium (a), said hydraulic damping unit comprising a second volume (142) at least partially bounded by the reciprocating piston (111), wherein the piston compressor (100) is configured to feed the hydraulic medium (a) into the first volume (141) and/or to discharge the hydraulic medium (a) from the first volume (141) when required, in a manner which is dependent upon the position of the hydraulic piston (120) and/or the rotational angle (φ) of the shaft (121) provided for moving the hydraulic piston (120) in relation to the position (x) of the reciprocating piston (111) and/or the pressure (p) in the first volume (141), said piston compressor further comprising a first valve (150) by means of which the second volume (142) can be connected to the first volume (141), and a second valve (155) by means of which the hydraulic medium (a) can be discharged from the first volume (141) into a reservoir (130) for the hydraulic medium.

18. The piston compressor (100) according to claim 17, further comprising a third valve (153) by means of which the first volume (141) can be connected to the reservoir (130) for the hydraulic medium.

19. The piston compressor (100) according to claim 17, wherein by means of the first valve (150) and the second valve (155), a quantity of the medium (b) to be conveyed by means of the piston compressor can be reduced.

20. The piston compressor (100) according to claim 17, further comprising a pump (131), a heat exchanger (132), and a check valve (153) for conveying hydraulic medium (a) from the reservoir (130) to the first volume (141).

21. The piston compressor (100) according to claim 17, wherein a quantity of the medium (b) to be conveyed by means of the piston compressor can be increased by closing the first valve (150) which, due to the hydraulic damping unit (140), results in a restriction of movement of the reciprocating piston (111) in a direction of the hydraulic drive as the hydraulic piston (120) moves downwards.

22. The piston compressor (100) according to claim 21, wherein, when first valve (150) is closed resulting in restriction of movement of the reciprocating piston (111) in the direction of the hydraulic drive as the hydraulic piston (120) moves downwards, hydraulic medium (a) is withdrawn from the reservoir (130) via a check valve (153) and introduced into the first volume (141) due to resultant negative pressure in the first volume (141).

* * * * *